US007287538B2

(12) United States Patent
Lin et al.

(10) Patent No.: US 7,287,538 B2
(45) Date of Patent: Oct. 30, 2007

(54) ILLUMINATING UMBRELLA GRIP

(75) Inventors: Chung-Kuang Lin, Taipei Hsien (TW); Jung-Jen Chang, Taipei Hsien (TW)

(73) Assignee: Fu Tai Umbrella Works, Ltd., Taipei Hsien (TW)

( * ) Notice: Subject to any disclaimer, the term of this patent is extended or adjusted under 35 U.S.C. 154(b) by 300 days.

(21) Appl. No.: 11/008,283

(22) Filed: Dec. 10, 2004

(65) Prior Publication Data

US 2006/0124158 A1 Jun. 15, 2006

(51) Int. Cl.
*A45B 3/02* (2006.01)

(52) U.S. Cl. ..... 135/16; 135/910; 362/102

(58) Field of Classification Search ..... 362/102; 135/910

See application file for complete search history.

(56) References Cited

U.S. PATENT DOCUMENTS 2,259,443 A * 10/1941 Geier ..... 362/102
2,372,471 A * 3/1945 Campbell ..... 135/66
2,734,124 A * 2/1956 Funk ..... 362/102
3,281,586 A * 10/1966 Gonzalez ..... 362/102
5,493,480 A * 2/1996 Huang ..... 362/102
5,848,831 A * 12/1998 Tatsumi ..... 362/102
6,126,291 A * 10/2000 Chung-Kuang et al. .... 362/102
6,752,509 B1 * 6/2004 Lin et al. ..... 362/102
6,959,469 B2 * 11/2005 Blauer et al. ..... 16/431
7,063,434 B2 * 6/2006 Wu ..... 362/102
2006/0096625 A1 * 5/2006 Chen et al. ..... 135/16

* cited by examiner

*Primary Examiner*—David Dunn
*Assistant Examiner*—Tania Abraham
(74) *Attorney, Agent, or Firm*—Troxell Law Office, PLLC

(57) ABSTRACT

An illuminating umbrella grip includes a light-transmitting deformable grip member, a lamp device secured to a central bottom portion of the grip member, and a central shaft secured to a central upper portion of the grip member; wherein the grip member includes a hollow cylinder for respectively securing the central shaft and the lamp device in the hollow cylinder, a flexible cover jacketed on the hollow cylinder and generally formed as a dumbbell or calabash shape surrounding the hollow cylinder, and a deformable light-transmitting layer sandwiched in between the hollow cylinder and the flexible cover; whereby upon lighting up of the lamp device, the light as emitted from the lamp device will be transmitted outwardly through the grip member for illumination.

4 Claims, 3 Drawing Sheets

ILLUMINATING UMBRELLA GRIP

BACKGROUND OF THE INVENTION

U.S. Pat. No. 6,968,599 invented by Jeff Blauer et. al. disclosed a pliable handle including a core member, an outer sheath disposed about the core member, and gel disposed between the core member and the outer sheath.

However, this prior art has the following drawbacks:

1. Several gel injection bores should be provided in the core member for injecting gel into the chamber confined between the core member and the outer sheath, thereby increasing the production cost and injection inconvenience.
2. The handle is not illuminative. The core member is formed as a solid, providing no way or space for accommodating an illuminator such as a bulb or LED therein.

The present inventor has found the drawbacks of the prior art, and invented the present invention of illuminating umbrella grip.

SUMMARY OF THE INVENTION

The object of the present invention is to provide an illuminating umbrella grip including a light-transmitting deformable grip member, a lamp device secured to a central bottom portion of the grip member, and a central shaft secured to a central upper portion of the grip member; wherein the grip member includes a hollow cylinder for respectively securing the central shaft and the lamp device in the hollow cylinder, a flexible cover jacketed on the hollow cylinder and generally formed as a dumbbell or calabash shape surrounding the hollow cylinder, and a deformable light-transmitting layer sandwiched in between the hollow cylinder and the flexible cover; whereby upon lighting up of the lamp device, the light as emitted from the lamp device will be radially transmitted outwardly through the grip member for illumination.

DETAILED DESCRIPTION

Figure 1:
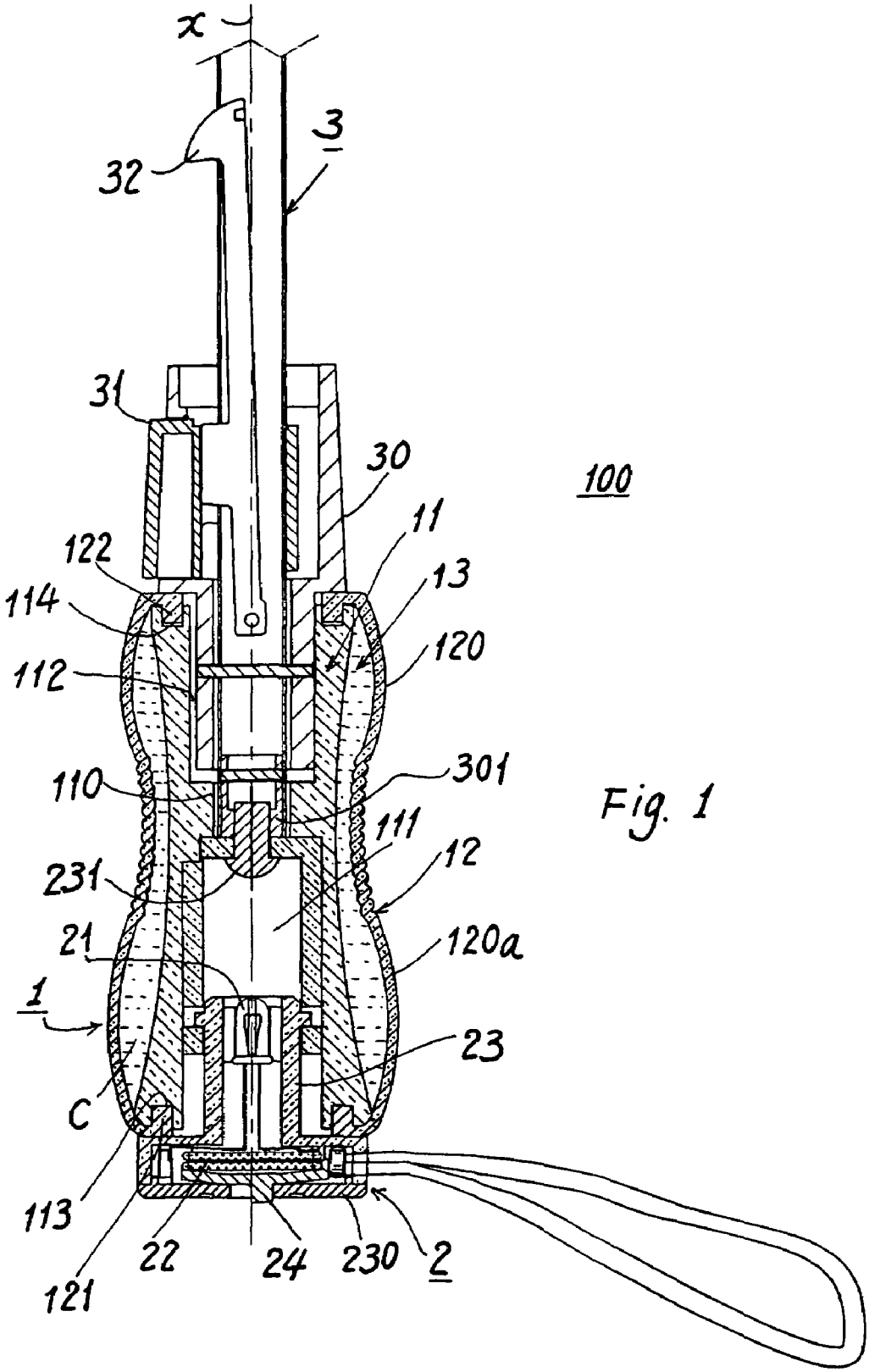
FIG. 1 is a sectional drawing of the present invention when assembled.

As shown in the drawing figures, the illuminating umbrella grip 100 of the present invention comprises: a light-transmitting deformable grip member 1, a lamp device 2 secured to a central lower portion of the grip member 1, and a central shaft 3 secured to a central upper portion of the grip 1 for pivotally securing a rib assembly (not shown) on the shaft 3.

The grip member 1 includes: a transparent hollow cylinder (or tube) 11 disposed about a longitudinal axis X of the grip member 1 and the central shaft 3; a light-transmitting flexible cover 12 jacketed on the hollow cylinder 11 having at least a convex portion 120 (or 120*a*) radially protruding outwardly from the longitudinal axis X to generally form a dumbbell or calabash shape (of which the shapes are not limited in this invention); and a deformable light-transmitting layer 13 sandwiched in between the hollow cylinder 11 and the flexible cover 12.

The deformable light-transmitting layer 13 may be selected from the group consisting of: gel, silicon-gel insert, or any other transparent or translucent deformable materials formed, inserted or loaded into a chamber C defined between the hollow cylinder 11 and the flexible cover 12.

The flexible cover 12 may be formed with silicon rubber or any other flexible materials having proper transparency, but not limited in this invention.

The light-transmitting layer 13 and the flexible cover 12 may be colored by adding pigments therein.

Figure 2:
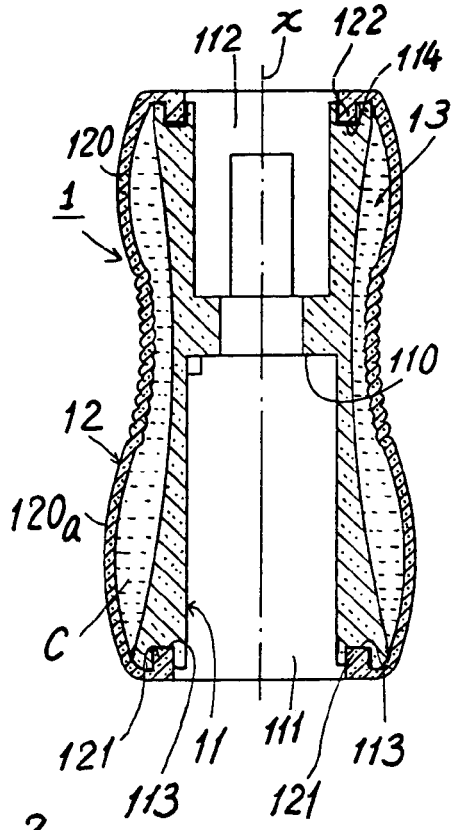
FIG. 2 is a sectional drawing of the grip member of the present invention.
Figure 3:
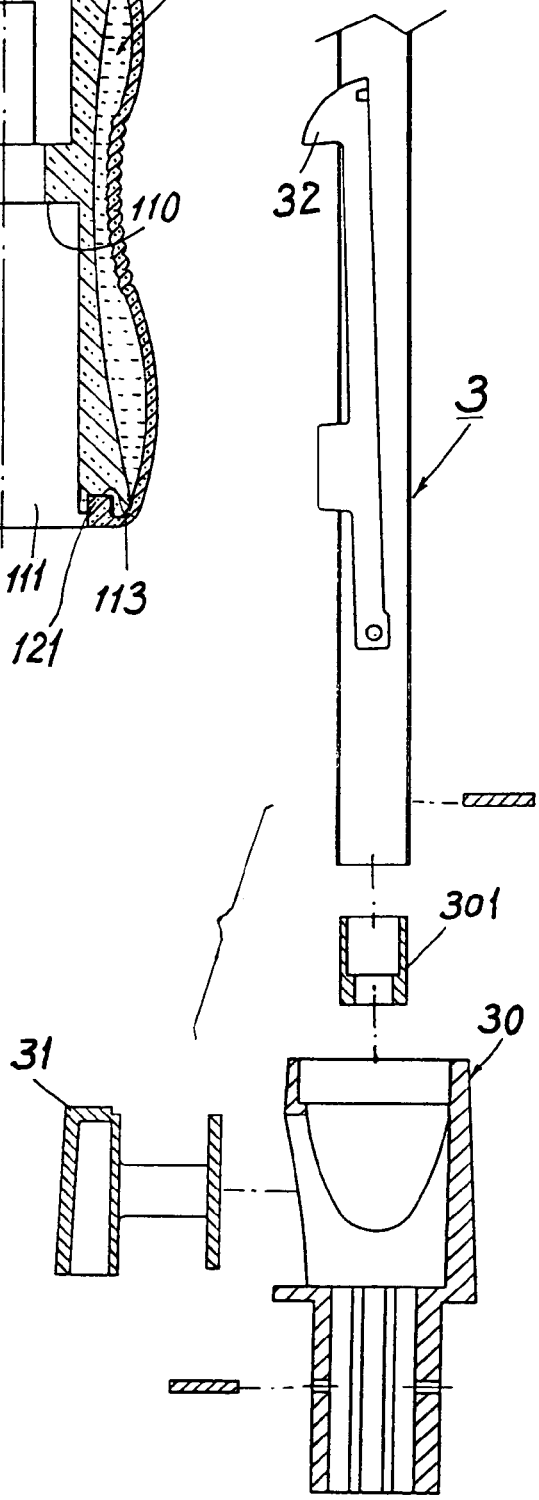
FIG. 3 is a partial exploded sectional view showing the elements of the central shaft of the present invention.
Figure 4:
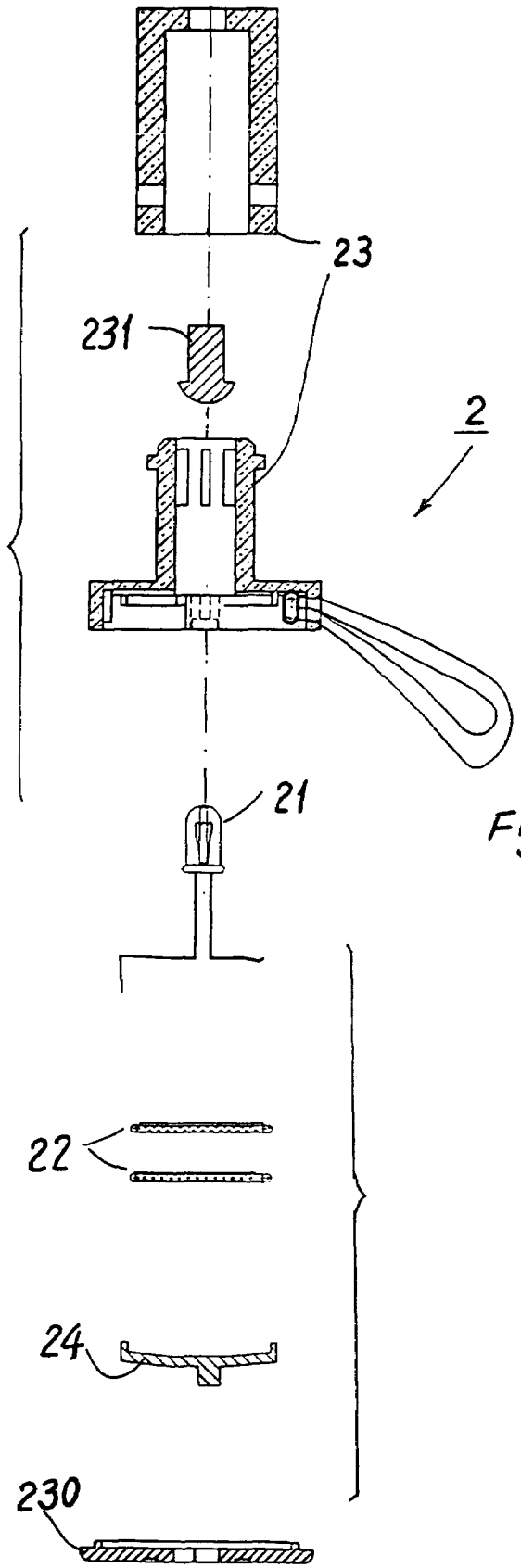
FIG. 4 is an exploded sectional view of the lamp device of the present invention.

The grip member 1 as shown in FIG. 2 may be formed by filling gel or foaming material into the chamber C between the hollow cylinder 11 and the flexible cover 12 and then subjected to a reaction such as a foaming process of a foam composition or a catalytic reaction of a gel composition to complete the gel form formed in situ in between the hollow cylinder 11 and the flexible cover 12. So, the deformable light-transmitting layer 13 and the grip member 1 may be formed in situ in a mold or form for a quicker production of the grip member 1, not limited in the present invention.

Or, the deformable light-transmitting layer 13 may be formed as a preformed insert which is then inserted into the chamber in between the hollow cylinder 11 and the flexible cover 12.

The hollow cylinder 11 includes: a lower socket 111 for mounting the lamp device 2 in the lower socket 111, and an upper socket 112 for securing a base portion 30 of the central shaft 3 in the upper socket 112.

The hollow cylinder 11 further includes: a bottom groove 113 annularly recessed in a bottom rim of the hollow cylinder 11 for engaging a bottom extension 121 annularly formed on and protruding upwardly from a bottom periphery of the flexible cover 12; and a top groove 114 annularly recessed in a top rim of the hollow cylinder 11 for engaging a top extension 122 annularly formed on and protruding downwardly from a top periphery of the flexible cover 12. Such an engagement between each extension 121 or 122 with each groove 113 or 114 will make a well storing or accommodation of the light-transmitting layer 13 within the chamber C in between the hollow cylinder 11 and the flexible cover 12. The top extension 122 and the top groove 114 may also provide an aperture therebetween for releasing air or bubbles from the chamber C of the grip member 1. Such an aperture may then be eliminated after firmly securing the shaft 3 and the lamp device 2 with the grip 1 in accordance with the present invention.

Other methods or processes for forming, mounting or filling the light-transmitting layer 13 into the chamber between the cylinder 11 and the cover 12 may be modified by those skilled in the art, not limited in the present invention.

The central shaft 3 includes a base portion 30 which is engaged or secured in the upper socket 112 in the hollow cylinder.

The lamp device 2 includes a lamp casing 23 protruding upwardly and engaged in the lower socket 111 in the hollow cylinder 11, having a screw (or bolt) 231 rotatably secured through a middle partition 110 horizontally formed in a middle section of the hollow cylinder 11 to be engaged with a bottom plug 301 formed in a bottom of the central shaft 3 within the base portion 30 of the shaft 3 to couple the lamp casing 23 and the bottom plug 301 to stably secure the shaft 3 and the lamp device 2 with the grip member 1.

The central shaft 3 includes a control device 31 such as a push bottom slidably mounted in the base portion 30 of the shaft 3 and a spring catch 32 depressibly unlocked by the control device 31 for opening the umbrella, which is so conventional and not described in detail in this invention. Other control devices or mechanism for opening or closing the umbrella secured to the central shaft 3 may be modified and used in this invention, which are not limited.

The lamp device 2 includes: a LED (light-emitting diode) 21 electrically connected to a power source of batteries 22, a lamp casing 23 for mounting the LED 21 therein and secured (or detachably secured) in a central bottom portion of the grip member 1, and a switch 24 operatively switching on or off the power source 22 and movably mounted in a bottom cap 230 of the lamp casing 23.

The LED 21 may also be replaced with a bulb or any other illuminators, not limited in this invention.

Upon lighting up of the lamp device 2, the light of LED (or bulb) 21 will be transmitted outwardly through the grip member 1 for illumination. When the grip member 1 is made as color one, it may still maintain a proper light transmitting performance through the grip.

Since the grip member 1 is deformable, it may be grasped by a user's hand or fingers more tightly and comfortably.

The present invention is superior to the prior art including U.S. publication No. 20040205937 A1 with the following advantages:

1. The deformable grip member 1 provides a simpler structure and mechanism for forming the light-transmitting layer 13 therein for simplifying the assembly and for decreasing the production cost of the umbrella grip.
2. The soft umbrella grip may help a comfortable stable and tight grasping or holding of the umbrella grip, which is so important when served as optical lighting or safety warning purpose in a dark weather or night time, when implemented with the lamp device 2 in combination with the deformable grip member 1 in accordance with the present invention.
3. The deformable grip member 1, besides its comfortable and tight holding function, may serve as a shock-absorbing buffer when impacted by an external force or falling down to the ground for protecting the LED (or bulb) 21 of the lamp device 2 for playing double duties, both for comfortable tight holding of an umbrella grip and for safe protection of the lamp device secured to the umbrella grip.
4. The convex portions 120, 120*a* formed on the grip member 1 may act, more or less, as a lens for magnifying the light beams as emitted from the lamp device 2 for enhancing the illumination of the umbrella grip.

The present invention may be modified without departing from the spirit and scope of the present invention.

We claim:

1. An illuminating umbrella grip comprising:

a light-transmitting deformable grip member for securing a central shaft of an umbrella on said grip member, said deformable grip member adapted for a comfortable tight holding thereof; and a lamp device secured in said grip member, whereby upon lighting up of said lamp device, the light as emitted from said lamp device will be radially transmitted outwardly through said light-transmitting deformable grip member for illumination, said grip member including: a transparent hollow cylinder disposed about a longitudinal axis of the grip member and the central shaft; a light-transmitting flexible cover jacketed on the hollow cylinder; and a deformable light-transmitting layer sandwiched in between the hollow cylinder and the flexible cover;

said hollow cylinder including: a lower socket for mounting the lamp device in the lower socket, and an upper socket for securing a base portion of the central shaft in the upper socket of the hollow cylinder; and said lamp device including a lamp casing protruding upwardly and engaged in the lower socket in the hollow cylinder, having a screw rotatably secured through a middle partition horizontally formed in a middle section of the hollow cylinder to be engaged with a bottom plug formed in a bottom of the central shaft within the base portion of the shaft to couple the lamp casing and the bottom plug to stably secure the central shaft and the lamp device with the grip member; and said lamp device further including: a LED electrically connected to a power source of batteries, said lamp casing having the LED mounted therein and secured in a central bottom portion of the grip member, and a switch operatively switching on or off the power source and movably mounted in a bottom cap of the lamp casing.

2. An umbrella grip according to claim 1, wherein said deformable light-transmitting layer is selected from the group consisting of: gel, a silicon-gel insert, and transparent or translucent deformable material formed in a chamber defined between the hollow cylinder and the flexible cover.

3. A grip according to claim 1, wherein said deformable light-transmitting layer is formed as a preformed insert to be loaded into a chamber in between the hollow cylinder and the flexible cover.

4. A grip according to claim 1, wherein said hollow cylinder includes: a bottom groove annularly recessed in a bottom rim of the hollow cylinder for engaging a bottom extension annularly formed on and protruding upwardly from a bottom periphery of the flexible cover; and a top groove annularly recessed in a top rim of the hollow cylinder for engaging a top extension annularly formed on and protruding downwardly from a top periphery of the flexible cover.

* * * * *